US007389981B2

(12) United States Patent
Lee et al.

(10) Patent No.: US 7,389,981 B2
(45) Date of Patent: Jun. 24, 2008

(54) PAPER FEEDING APPARATUS FOR PRINTER HAVING DOUBLE FEED PREVENTION UNIT

(75) Inventors: Jin-Soo Lee, Suwon-si (KR); Heung-Sup Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 287 days.

(21) Appl. No.: 11/078,618

(22) Filed: Mar. 14, 2005

(65) Prior Publication Data

US 2005/0242486 A1 Nov. 3, 2005

(30) Foreign Application Priority Data

Apr. 30, 2004 (KR) ..... 10-2004-0030454

(51) Int. Cl.
*B65H 3/44* (2006.01)

(52) U.S. Cl. ..... 271/97; 271/162

(58) Field of Classification Search ..... 271/97, 271/90, 167

See application file for complete search history.

(56) References Cited

U.S. PATENT DOCUMENTS 6,354,585 B1 * 3/2002 Takahashi ..... 271/97

FOREIGN PATENT DOCUMENTS

| | | | |
|---|---|---|---|
| JP | 57-099677 | | 6/1982 |
| JP | 03211136 A | * | 9/1991 |
| JP | 06-202425 | | 7/1994 |
| JP | 07-199775 | | 8/1995 |
| JP | 2003-177653 | | 6/2003 |
| KR | 1996-0036624 | | 12/1996 |
| KR | 2000-0045982 | | 7/2000 |
| KR | 2003-0066173 | | 8/2003 |
| KR | 2004-001805 | | 1/2004 |

* cited by examiner

*Primary Examiner*—Kaitlin S Joerger
(74) *Attorney, Agent, or Firm*—Roylance, Abrams, Berdo & Goodman L.L.P.

(57) ABSTRACT

A paper feeding apparatus of a printer is provided and includes a double feed prevention unit. The paper feeding apparatus includes a finger unit for generating a curl at a front edge portion of the paper picked up by the pick-up roller. The finger unit presses the front edge portion of the paper that is mounted on the knock-up plate. A ventilation device is also provided to form an air gap under the picked paper by injecting air in the air chamber toward the front edge portion of the paper.

8 Claims, 5 Drawing Sheets

PAPER FEEDING APPARATUS FOR PRINTER HAVING DOUBLE FEED PREVENTION UNIT

BACKGROUND OF THE INVENTION

This application claims the benefit under 35 U.S.C § 119(a) of Korean Patent Application No. 10-2004-0030454, filed on Apr. 30, 2004, the entire disclosure of which is hereby incorporated by reference.

1. Field of the Invention

The present invention relates to a paper feeding apparatus for a printer. More particularly, the present invention relates to a paper feeding apparatus for a printer including a double feed prevention unit to prevent two or more sheets of paper from being supplied simultaneously.

2. Description of the Related Art

In general, an image forming apparatus such as a printer or a copying machine includes a paper feeding apparatus. The paper feeding apparatus stores a plurality of sheets of paper and supplies a sheet of paper to a main body of the printer sequentially.

FIG. 1 shows a typical structure for an electrophotographic color image forming apparatus.

Referring to FIG. 1, the electrophotographic image forming apparatus includes a photosensitive drum 10 that is a photosensitive medium. Next, the apparatus includes a charging device 11 that charges the photosensitive drum 10, a laser scanning unit (LSU) 12 that scans light onto the charged photosensitive drum 10 to form a predetermined electrostatic latent image, and a developing unit 13 that develops the electrostatic latent image with toners of four colors, such as, yellow (Y), magenta (M), cyan (C), and black (K). A transfer belt 14 overlaps images of the four colors developed on the photosensitive drum 10 sequentially, a first transfer roller 14*a* transfers the images developed on the photosensitive drum 10 onto the transfer belt 14, a second transfer roller 14*b* transfers the overlapped image of four colors on the transfer belt 14 onto a sheet of paper, and a fusing device 15 heats and presses the paper to permanently fuse the transferred image.

The apparatus also includes a photosensitive drum cleaning blade 17, an eraser 18, a conveying path 19 through which the paper is discharged, and a paper cassette 20.

As shown in FIG. 2, the typical paper feeding apparatus of the printer includes a paper cassette 20 that is detachably installed on the main body of the printer to store multiple sheets of paper. The paper cassette 20 includes a knock-up plate 22, on which the paper P is mounted, and lifts up the front edge portion of the mounted paper P. In addition, a semicircular pick-up roller 28 is rotatably installed on the main body of the printer to contact the front edge portion of the uppermost paper P that is lifted by the knock-up plate 22. Therefore, when the pick-up roller 28 rotates, the uppermost paper P enters the main body of the printer through frictional engagement with the pick-up roller 28. The apparatus further includes a paper guide 26 to guide the paper that enters the main body of the printer.

The conventional paper feeding apparatus having the above structure includes a finger unit 24 to prevent paper from being fed in duplicate. The finger unit 24 pressingly supports the front edge portion of the paper P mounted on the knock-up plate 22 to generate a curl at the front edge portion of the paper P when the pick-up roller 28 rotates, thereby separating the uppermost paper P easily.

However, in the typical paper feeding apparatus, the sheets of paper P may be attached to each other due to an electrostatic force between the sheets of paper, thus two or more sheets of paper P can be conveyed even using the finger unit 24.

Accordingly, there is a need for a paper feeding apparatus for a printer that includes a double feed prevention unit to prevent two or more sheets of paper from being supplied simultaneously.

SUMMARY OF THE INVENTION

An aspect of the present invention is to solve at least the above problems and/or disadvantages and to provide a paper feeding apparatus for a printer, including a double feed prevention unit that prevents paper from being fed in duplicate by blowing air toward a front edge portion of the paper that is supplied into a main body of a printer to separate the paper.

According to an aspect of the present invention, there is provided a paper feeding apparatus of a printer, the paper feeding apparatus includes a paper cassette being detachably coupled to a main body of a printer to store sheets of paper. A knock-up plate is installed inside the paper cassette to push upwardly on an upper portion of the sheets of paper. A pick-up roller is provided to convey the sheets of paper loaded on the knock-up plate to a printing path. A paper guide is also provided having a slanted surface to guide the paper conveyed by the pick-up roller and an air chamber arranged thereon. A finger unit is configured to press the front edge portion of the paper that is mounted on the knock-up plate and for generating a curl. A ventilation device forms an air gap under the picked paper by injecting air in the air chamber toward the front edge portion of the paper so that the sheets of paper are curled by the finger unit through a ventilation path formed on the slanted surface of the paper guide.

It is preferable that the ventilation device include a fan having an outlet of connected to the air chamber.

It is preferable that the ventilation path has a plurality of holes that are arranged in a row that is substantially parallel to a width direction of the sheets of paper in predetermined intervals.

The ventilation path may also be a slit formed in a width direction of the sheet of paper.

The fan may also be integrally installed with the paper cassette.

It is also preferable that the fan include an inlet for intaking external air. The ventilation device also may include a first pipe that extends from the inlet toward the fusing device and a second pipe that extends from the fusing device in the main body of the printer to connect to the first pipe in the paper cassette.

The outlet of the fan may be connected to the air chamber at a side of the paper guide.

Therefore, an air gap may be formed under the picked paper by the air injected from the ventilation device toward the front edge portion of the paper. Thus the sheets of paper are separated relatively easily and double feed operation of the sheets of paper is prevented.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, and features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for conciseness.

Figure 1:
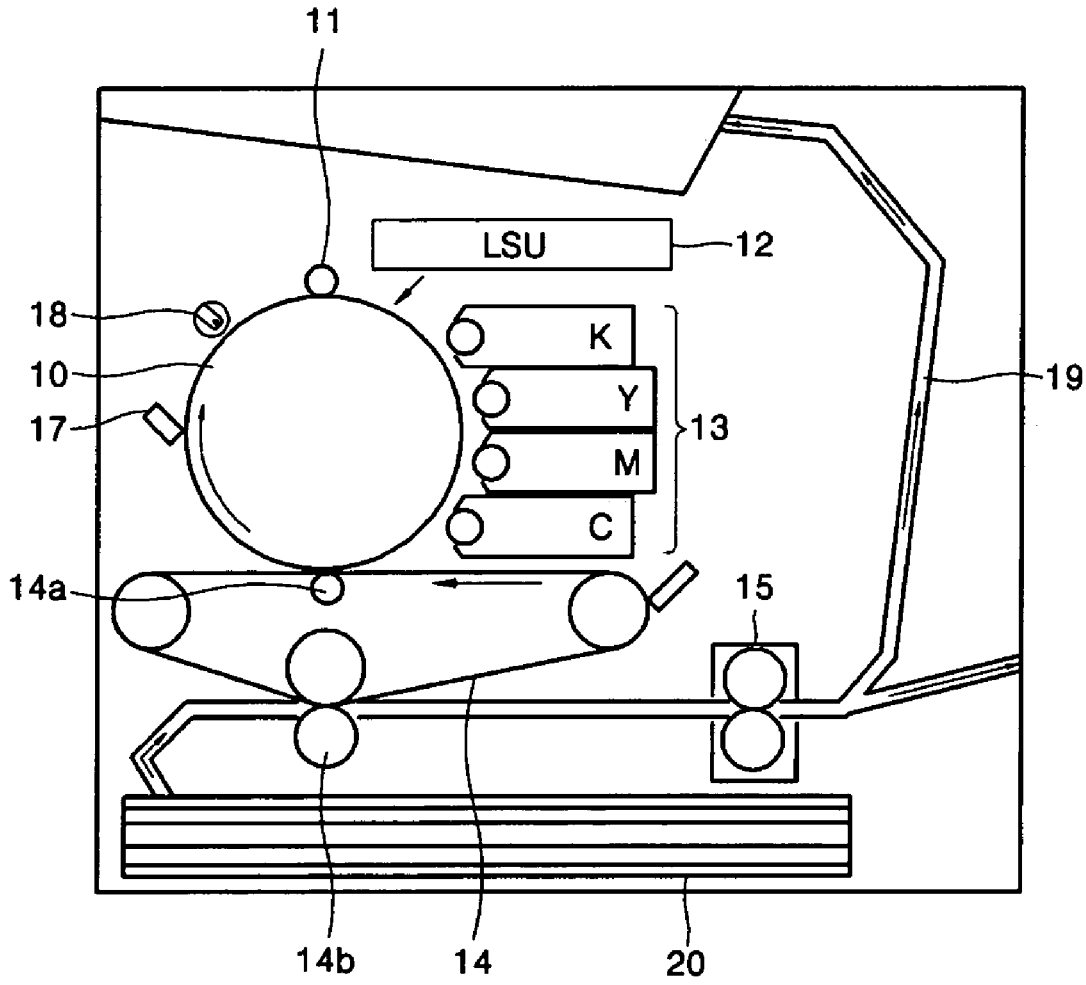
FIG. 1 (PRIOR ART)
FIG. 1 is a side elevational view showing a structure of a conventional electrophotographic color image forming apparatus.
Figure 2:
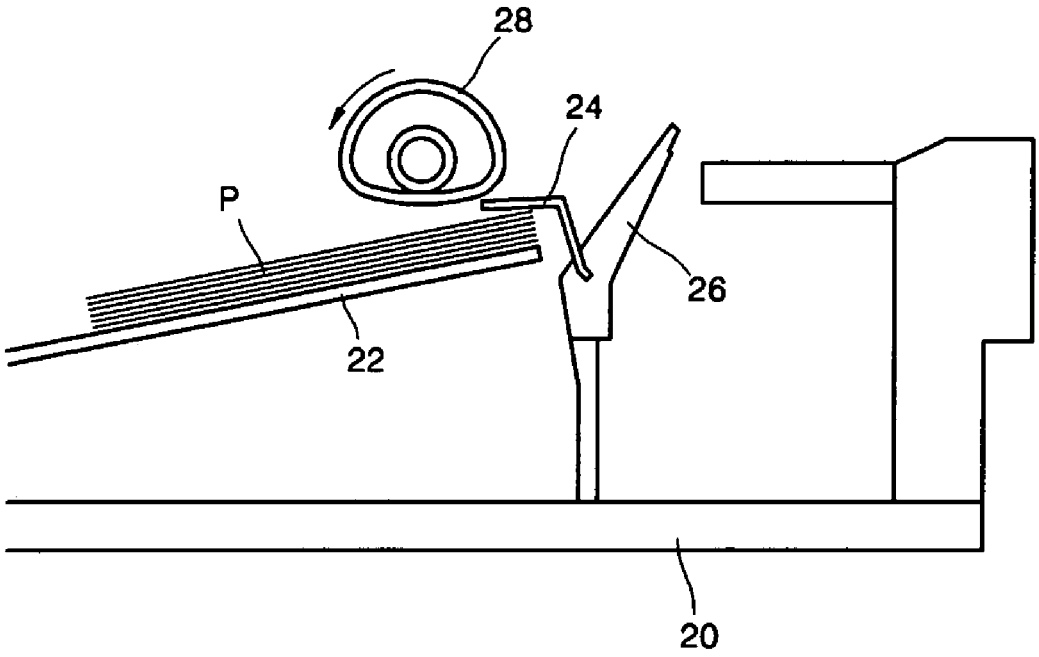
FIG. 2 (PRIOR ART)
FIG. 2 is a schematic side view showing a paper supplying apparatus of a conventional printer.
Figure 3:
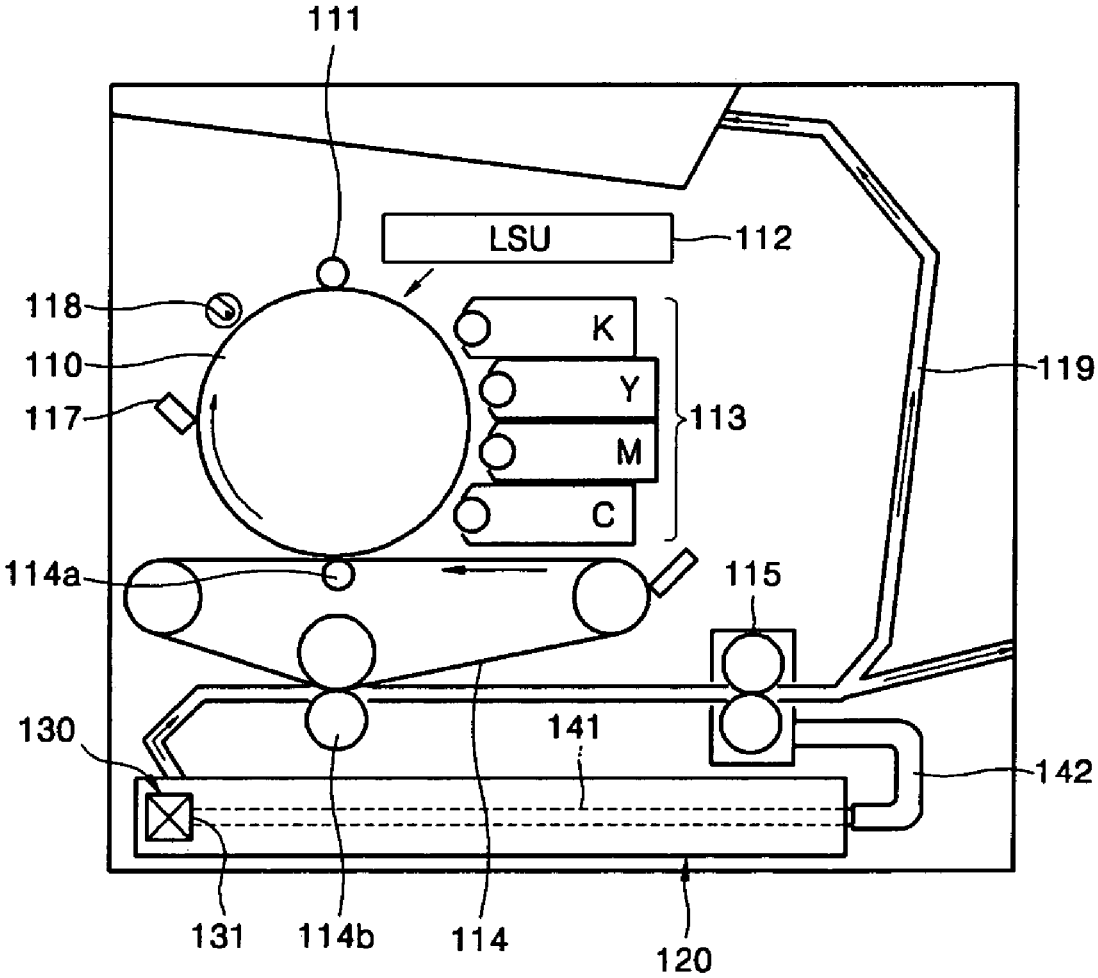
FIG. 3 is a view showing an image forming apparatus including a paper feeding apparatus according to an exemplary embodiment of the present invention.

FIG. 3 is a view showing a structure of an image forming apparatus including a paper feeding apparatus according to the present invention.

Referring to FIG. 3, a color image forming apparatus of an electrophotographic type includes a photosensitive drum 110, that is, a photosensitive medium, a charging device 111 for charging the photosensitive drum 110, a laser scanning unit (LSU) 112 for scanning laser onto the charged photosensitive drum 110 to form a predetermined electrostatic latent image. Also provided are developing units 113 to develop electrostatic latent image using toners of four colors, that is, yellow (Y), magenta (M), cyan (C), and black (K). A transfer belt 114 is provided for sequentially overlapping the images of four colors developed on the photosensitive drum 110. Furthermore, there is provided a first transfer roller 114*a* for transferring the image developed on the photosensitive drum 110 onto the transfer belt 114, a second transfer roller 114*b* for transferring the image overlapped by four colors on the transfer belt onto a sheet of paper, and a fusing device 115 for permanently fusing the transferred image by heating and pressing the paper.

As best seen in FIG. 3, a photosensitive drum cleaning blade 117, an eraser 118, a conveying path 119 for discharging the paper, and a paper cassette 120 are illustrated.

Figure 4:
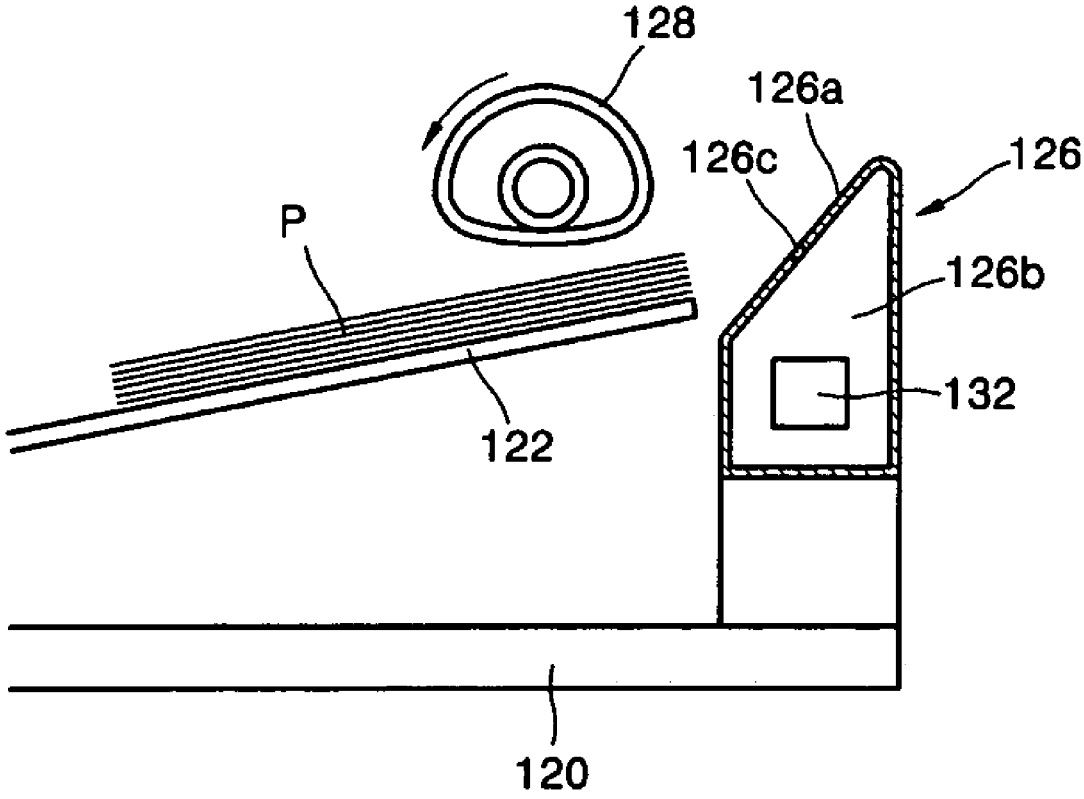
FIG. 4 is a schematic side view of the paper feeding apparatus of FIG. 3 showing a double feed prevention unit.
Figure 5:
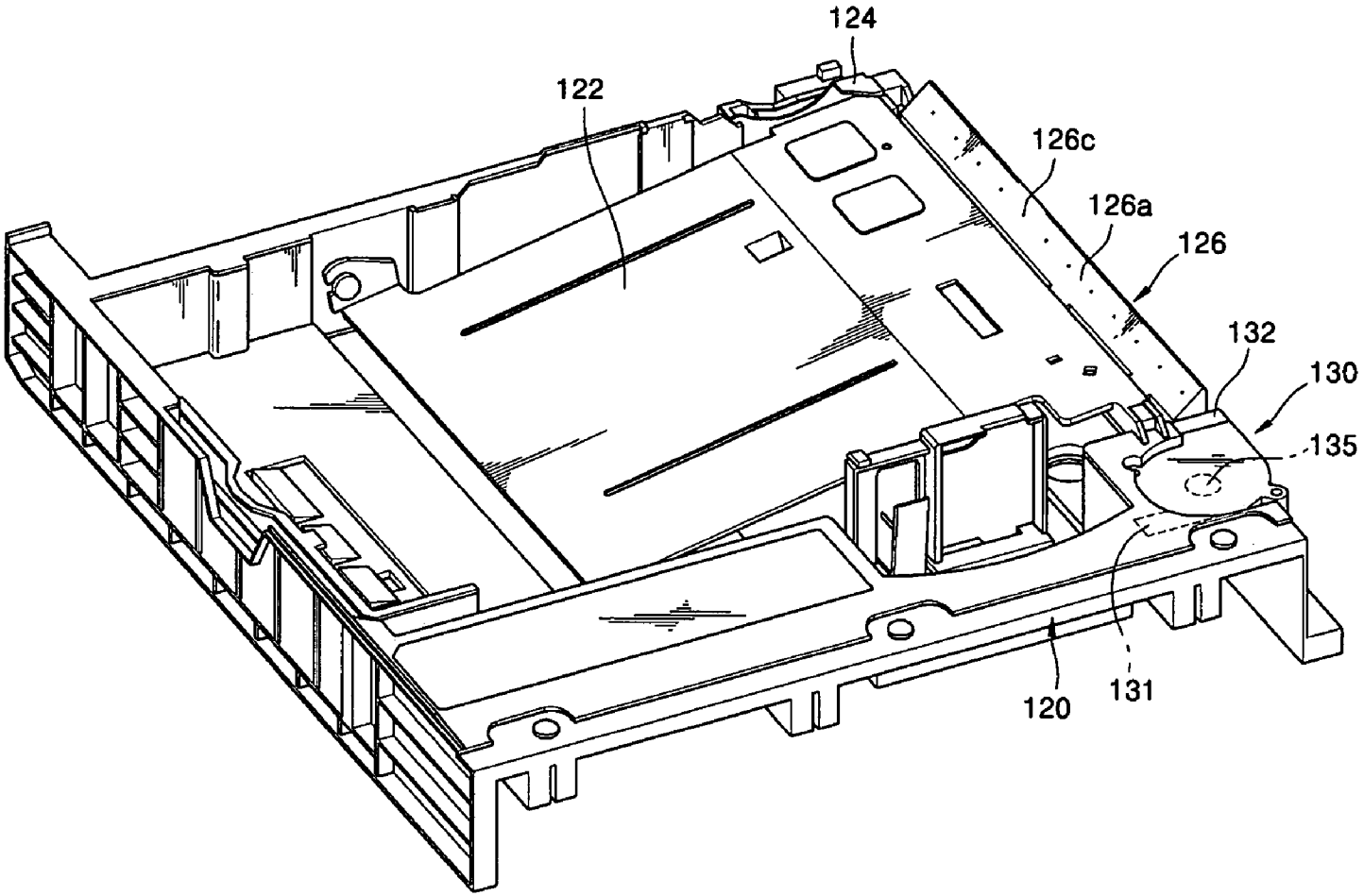
FIG. 5 is a perspective view of showing a portion of the paper feeding apparatus of FIG. 4.

FIG. 4 is a schematic side view showing a paper feeding apparatus of a printer including a double feed prevention unit. FIG. 5 is a perspective view showing a portion of FIG. 4.

Referring to FIGS. 3-5, the paper cassette 120 stores sheets of paper P, and is installed detachably on a main body of the printer. The paper cassette 120 includes a knock-up plate 122 that lifts up a front edge portion of the mounted paper P. In addition, a pick-up roller 128 that is preferably of substantially semicircular shape is rotatably installed on the main body of the printer. The pick-up roller 128 contacts the front edge portion of the uppermost paper among the sheets of paper lifted by the knock-up plate 122. When the pick-up roller 128 rotates, the uppermost sheet of paper P enters a printing path through frictional engagement with the pick-up roller 128. In addition, a paper guide 126 guides the paper entering the main body of the printer. The paper guide 126 is installed in front of a front portion of the paper P.

The paper feeding apparatus according to an exemplary embodiment of the present invention includes the double feed prevention unit for preventing two or more sheets of paper P from being conveyed into the main body of the printer simultaneously. The double feed prevention unit includes a finger unit 124 to press upwardly on a front edge portion of the paper P mounted on the knock-up plate 122. Also provided is a ventilation device that blows air toward the front edge portion of the paper P for curling by the finger unit 124 and the pick-up roller 128.

The paper guide 126 includes a slanted surface 126*a* for guiding the paper that is conveyed onto the printing path and an air chamber 126*b* is arranged thereon. On the slanted surface 126*a* of the paper guide 126, a plurality of holes 126*c*, that is, ventilation holes are formed in parallel to a width direction of the paper P. Instead of a series of the holes 126*c*, a slit (not shown) may be formed on the surface 126*a* at a position of the holes 126*c* in parallel to the width direction of the paper P. A side of the paper guide 126 is connected to an outlet 132 of a fan 130, which will be described later.

The ventilation device is preferably integrally formed with the paper cassette 120. The ventilation device includes a fan 130 and a motor 135 for rotating the fan 130 at a center portion of the fan 130. An inlet 131 and an outlet 132 are formed at the fan 130. A first pipe 141 extends from the inlet 131 toward the fusing device 115. A second pipe 142 is connected to the fusing device 115 and is installed on the main body of the printer. Thus the first pipe 141 and the second pipe 142 are connected to each other when the paper cassette 120 is installed in the main body of the printer.

Power source for the motor 135 is preferably provided by utilizing first and second pipes 141 and 142. That is, when the paper cassette 120 is connected to the main body of the printer. However, other suitable arrangements and constructions may be used.

Operations of the double feed prevention unit according to an exemplary embodiment of the present invention will be described as follows.

When the paper P is mounted on the knock-up plate 122, it is preferable that the paper cassette 120 is installed in the main body. Next, the first pipe 141 of the ventilation device is preferably adhered to the second pipe 142, and the second pipe 142 is preferably fixed on the main body of the printer. In addition, when the pick-up roller 128 rotates to convey the paper P to the printing path, the uppermost paper among the paper P mounted on the knock-up plate 122 is picked by the frictional force created by the pick-up roller 128. At this time, the uppermost paper cannot proceed forward due to the finger unit 124 that pressingly supports the front edge portion of the sheet of paper. However, a curl is generated at the front edge portion of the paper to form a gap between the uppermost paper and the paper beneath the uppermost paper. In this state, it is preferable that warm air around the fusing device 115 is introduced into the inlet 131 of the fan 130 through the first and second pipes 141, 142, respectively. The air introduced into the fan 130 enters the air chamber 126*b* of the paper guide 126 through the outlet of the fan 130. The air in the air chamber 126*b* is injected toward the front edge portion of the paper P, which is curled, through the holes 126*c*. Then, an air gap is formed between the uppermost paper and the next sheet of paper. Therefore, even if an electrostatic force exists between the sheets of paper P, the sheets of paper P may still be separated in relatively easily, and accordingly, the double feeding of the paper may be prevented.

As described above, the paper feeding apparatus of the printer according to the exemplary embodiment of the present invention includes the ventilation device as the double feed prevention unit. The double feed prevention unit forms the air gap between the sheets of paper by injecting air injected from the ventilation device toward the front edge portion of the paper. Accordingly, the sheets of the paper may be separated relatively easily. Consequently, the double feeding operation of the paper may be prevented. Also, the warm air provided around the fusing device is introduced into the paper cassette to heat the paper, thereby reducing a loss of heat during the fusing process.

While the invention has been shown and described with reference to certain embodiments thereof, it will be understood by those skilled in the art that various changes in form and details may be made therein without departing from the spirit and scope of the invention as defined by the appended claims.

What is claimed is:

1. A paper feeding apparatus of a printer, the paper feeding apparatus comprises:

a paper cassette being detachably coupled to a main body of a printer to store sheets of paper;

a knock-up plate being installed on the paper cassette to push upwardly on the sheets of paper on an upper portion thereof a pick-up roller to convey the paper loaded on the knock-up plate to a printing path;

a paper guide having a slanted surface to guide the sheets of paper conveyed by the pick-up roller and an air chamber arranged thereon;

a finger unit configured to press a front edge portion of the sheets of paper picked up by the pick-up roller for generating a curl; and a ventilation device to form an air gap under the picked up sheets of paper by injecting air in the air chamber toward the front edge portion of the paper so that the sheets of paper are curled by the finger unit through a ventilation path located on the slanted surface of the paper guide, wherein the ventilation device includes a fan having an outlet connected to the air chamber, the fan is integrally installed with the paper cassette, and the fan includes an inlet to intake external air, and the ventilation device further includes a first pipe extending from the inlet toward a fusing device, and a second pipe extending from the fusing device on the main body of the printer to connect to the first pipe in the paper cassette.

2. The paper feeding apparatus of claim 1, wherein the ventilation path is a plurality of holes that are arranged in a row and substantially parallel to a width direction of the paper in predetermined intervals.

3. The paper feeding apparatus of claim 1, wherein the ventilation path is a slit formed in a width direction of the sheets of paper.

4. A printer comprising a developer for developing an electrostatic latent image formed on a photosensitive medium, a paper feeding apparatus for supplying sheets of paper, on which the toner image developed by the developer is transferred, and a fusing device for fusing the paper, on which the toner image is transferred, wherein the paper feeding apparatus comprises:

a paper cassette being detachably coupled to a main body of a printer to store the sheets of paper;

a knock-up plate being installed inside the paper cassette to push upwardly on the sheets of paper on an upper portion thereof;

a pick-up roller to convey the sheets of paper loaded on the knock-up plate to a printing path;

a paper guide having a slanted surface to guide the sheets of paper conveyed by the pick-up roller and an air chamber arranged thereon;

a finger unit configured to press a front edge portion of the sheets of paper picked up by the pick-up roller for generating a curl; and a ventilation device to form an air gap under the picked up sheets of paper by injecting air in the air chamber toward the front edge portion of the sheets of paper so that the sheets of paper are curled by the finger unit through a ventilation path formed on the slanted surface of the paper guide, wherein the ventilation device includes a fan having an outlet connected to the air chamber, the fan is integrally installed with the paper cassette, and the fan includes an inlet to intake external air, and the ventilation device further includes a first pipe extending from the inlet toward a fusing device, and a second pipe extending from the fusing device in the main body of the printer to connect to the first pipe in the paper cassette.

5. The printer of claim 4, wherein the ventilation path is a plurality of holes that are arranged in a row and substantially parallel to a width direction of the sheets of paper in predetermined intervals.

6. The printer of claim 4, wherein the ventilation path is a slit formed in a width direction of the sheets of paper.

7. The paper feeding apparatus of claim 1, wherein the outlet of the fan is connected to the air chamber on a side of the paper guide.

8. The printer of claim 4, wherein the outlet of the fan is connected to the air chamber on a side of the paper guide.

* * * * *